US007614520B2

(12) United States Patent
McEldowney et al.

(10) Patent No.: US 7,614,520 B2
(45) Date of Patent: Nov. 10, 2009

(54) TAB WITH COIN PRECURL FOR IMPROVED CURL FORMATION

(75) Inventors: Craig Allen McEldowney, Russia, OH (US); Mark Richard Mitchell, Sidney, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 349 days.

(21) Appl. No.: 11/443,803

(22) Filed: May 31, 2006

(65) Prior Publication Data

US 2007/0278230 A1 Dec. 6, 2007

(51) Int. Cl.
*B65D 17/34* (2006.01)
*B21D 51/44* (2006.01)

(52) U.S. Cl. ..... 220/269; 220/906; 413/12; 413/25

(58) Field of Classification Search ..... 220/269–273, 220/906; 413/12, 14, 15, 16, 25
See application file for complete search history.

(56) References Cited

U.S. PATENT DOCUMENTS 4,130,074 A 12/1978 Cudzik
4,210,257 A 7/1980 Radtke
4,211,335 A 7/1980 Langseder
4,361,251 A 11/1982 Langseder et al.
4,465,204 A * 8/1984 Kaminski et al. ..... 220/269
4,530,631 A 7/1985 Kaminski et al.
4,579,495 A 4/1986 Dassler et al.
5,038,956 A * 8/1991 Saunders ..... 220/271
5,524,698 A * 6/1996 Chen et al. ..... 164/72
5,590,993 A * 1/1997 Saunders ..... 413/12
5,967,726 A 10/1999 Turner et al.

* cited by examiner

*Primary Examiner*—Robin Hylton
(74) *Attorney, Agent, or Firm*—Eckert Seamans Cherin & Mellot, LLC; Grant E. Coffield, Esq.

(57) ABSTRACT

A tab is used to open beer/beverage can ends and food can ends. The tab has one or more arcuate strips that are provided on a surface of the tab proximate to a peripheral surface of the tab where the one or more arcuate strips have been formed further into a preselected portion of curled or hemmed portions of the tab. Tooling for the manufacture of the tab is also provided. A method for manufacturing the tab is additionally provided as well.

9 Claims, 5 Drawing Sheets

TAB WITH COIN PRECURL FOR IMPROVED CURL FORMATION

FIELD OF THE INVENTION

The invention generally relates to a tab used to open beer/beverage can ends and food can ends, tooling for the manufacture of the tab and a method of manufacturing the tab.

BACKGROUND OF THE INVENTION

A tab is typically secured to a can end and the can end is opened by lifting a lift portion of the tab by pulling upwards on the tab so as to pivot the tab about a rivet which secures the tab to the can end. Lifting the lift portion of the tab upwards fractures a score line disposed on the can end which permits the end-user to access the contents of the can end.

In the can making industry, approximately three hundred billion cans are manufactured every year. The industry consumes large volumes of metal in order to manufacture the considerable volume of cans. Can makers are constantly striving to reduce the gauge of metal that is used to manufacture tabs, can ends and can bodies in an effort to reduce their consumption of metal.

With regard to reducing the gauge of tab stock which is used to manufacture tabs, problems exist with manufacturing a tab with consistent and sufficient tab strength from reduced gauge metal. Also, problems exist with manufacturing an aesthetically appealing tab because the tab stock creates kinks and wrinkles in the curled portion of the tab. The kinks and wrinkles provide a tab with product variations and additionally contribute to the inconsistent tab strength problem because the metal does not flow in a predictable manner.

Accordingly, a need exists in the art for a tab, tooling for the manufacture of the tab and a method for the manufacture of the tab that manufactures the tab from reduced gauge tab stock that has consistent and sufficient tab strength. Another need exists in the art for a tab, tooling for the manufacture of the tab and a method for the manufacture of the tab that manufactures the tab from reduced gauge tab stock that manufactures a more aesthetically appealing tab with reduced kinks and wrinkles on the tab.

SUMMARY OF THE INVENTION

An object of the invention is to provide a tab, tooling for the manufacture of the tab and a method for the manufacture of the tab that manufactures the tab from reduced gauge tab stock that has consistent and sufficient tab strength.

Another object of the invention is to provide a tab, tooling for the manufacture of the tab and a method for the manufacture of the tab that manufactures the tab from reduced gauge tab stock that manufactures a more aesthetically appealing tab with reduced kinks and wrinkles on the tab.

Certain objects of the invention are achieved by providing a tab to be affixed to a can end. The tab has a nose portion located at a front end of the tab and a lift portion located at a back end of the tab. The nose portion and the lift portion have curled or hemmed portions located proximate to a peripheral surface of the tab. A rivet receiving portion is located proximate to the nose portion with a rivet hole. The rivet receiving portion is attached to the nose portion. A first surface and a second surface is provided on the tab. One or more arcuate strips are provided on the second surface of the tab proximate to the peripheral surface of the tab and the one or more arcuate strips have been formed further into a preselected portion of the curled or hemmed portions of the tab.

Other objects of the invention are achieved by providing tooling for the manufacture of a tab having a first surface and a second surface with the tab to be affixed to a can end. A first tool has a first generally planar surface connected to an arcuate surface connected to a first projection. A second tool has a second generally planar surface connected to a second projection. The first generally planar surface and the arcuate surface of the first tool are structured to cooperate with the projection of the second tool to form arcuate strips on the second surface of the tab proximate to a peripheral surface of the tab. The arcuate surface of the first tool is structured to wipe the peripheral surface of the tab over the second tool.

Other objects of the invention are achieved by providing a method of manufacturing a tab to be affixed to a can end, the method comprising: providing a tab having a first surface, a second surface and a peripheral surface; forming one or more arcuate strips into the second surface of the tab proximate to the peripheral surface of the tab; and wiping the peripheral portion of the tab to form an arcuate peripheral portion.

DETAILED DESCRIPTION OF THE PREFERRED EMBODIMENTS

Figure 1:
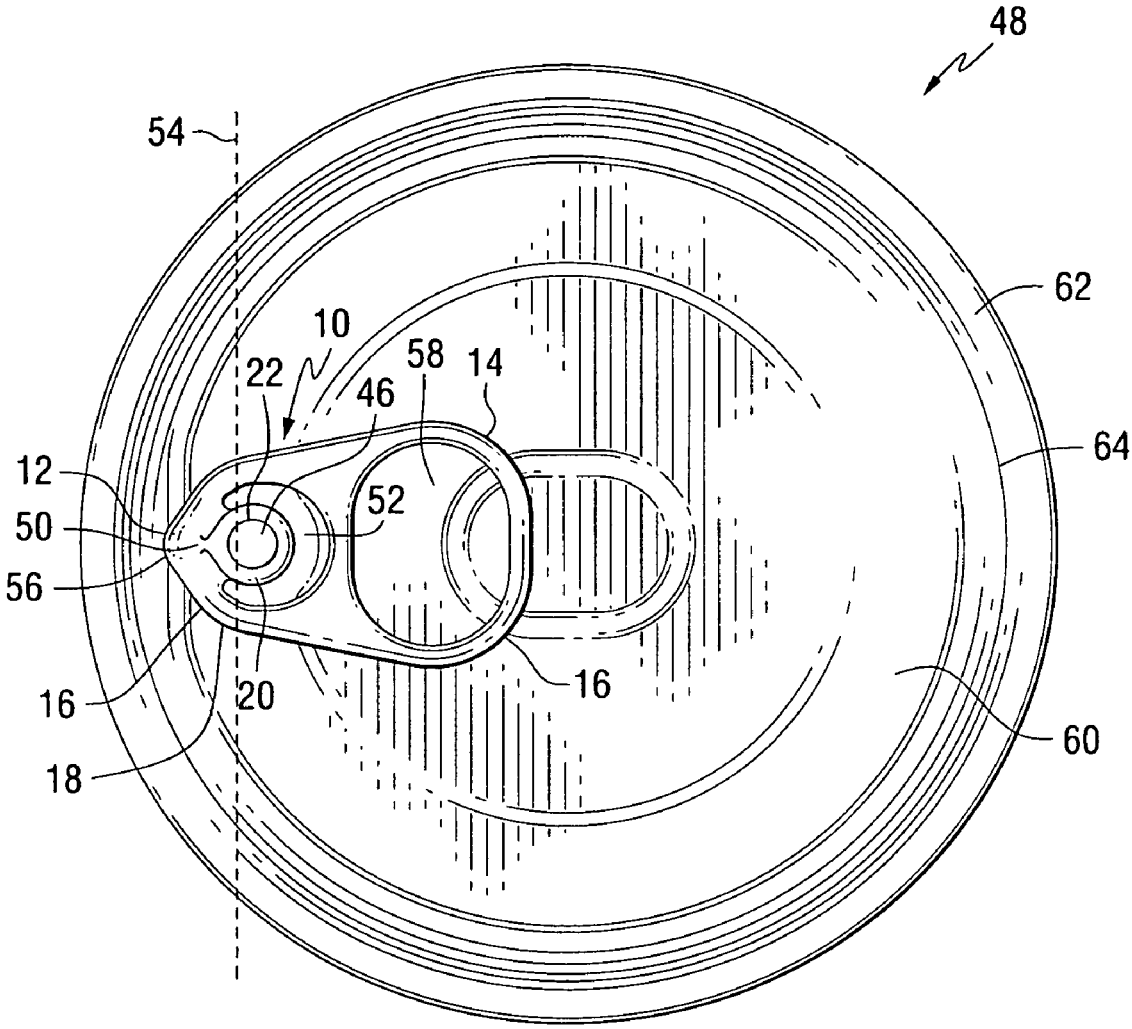
FIG. 1 is a top plan view of a tab affixed to a food can end.

For purposes of the description hereinafter, the terms "upper", "lower", "vertical", "horizontal", "axial", "top", "bottom", "aft", "behind", and derivatives thereof shall relate to the invention, as it is oriented in the drawing FIGS. However, it is to be understood that the invention may assume various alternative configurations except where expressly specified to the contrary. It is also to be understood that the specific elements illustrated in the FIGS. and described in the following specification are simply exemplary embodiments of the invention. Therefore, specific dimensions, orientations and other physical characteristics related to the embodiments disclosed herein are not to be considered limiting.

As used herein, the term "fastener" means any suitable fastening, connecting or tightening mechanism such as dowel pins, fasteners, rivets and the like. As used herein, the statement that two or more parts are "coupled" together means that the parts are joined together either directly or joined together indirectly through one or more intermediate parts. As used herein, the term "arcuate" means an elliptical or rounded: (i) arc; (ii) arch; (iii) bend; (iv) bow; (v) curve; and (vi) the like that have one or more radii of curvatures. As used herein, the term "tab" means rigid material that has undergone one or more forming and/or tooling operations.

Turning to FIG. 1, a tab 10 of the invention is shown. Tab 10 includes a nose portion 12 at the front end of tab 10 and a lift portion 14 at the back end of tab 10, wherein each portion is generally U-shaped along its periphery such that the two portions compliment each other to form the generally elliptical or oval shaped tab 10. Nose portion 12 and lift portion 14 may have curled or hemmed portions 16 located proximate to a peripheral surface 18 of the tab 10. See, FIG. 2 for a side cross-sectional view of curled or hemmed portions 16. The tab has a rivet receiving portion 20 located proximate to the nose portion 12. The rivet receiving portion 20 has a rivet hole 22 and is attached to the nose portion 12 through a panel.

Figure 3:
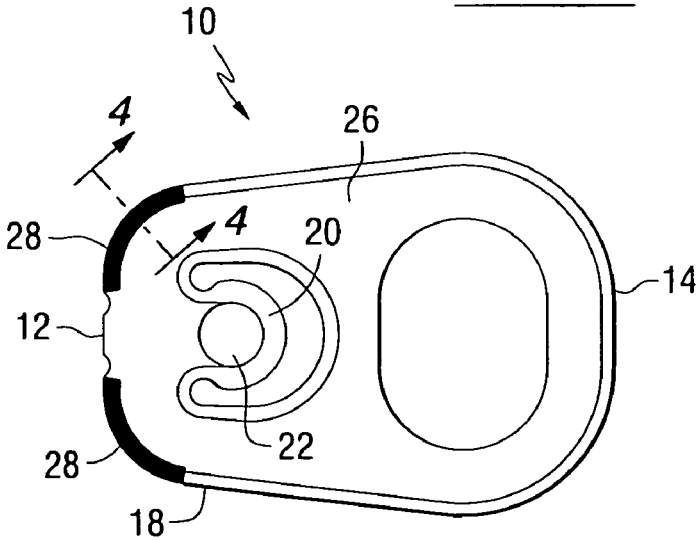
FIG. 3 is a bottom plan view of a tab with arcuate strips displayed in black for illustrative purposes.
Figure 4:
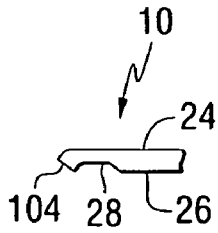
FIG. 4 is a side view of a tab.

A first surface 24 which is a top surface of the tab 10 and a second surface 26 which is a bottom surface of a tab 10 are provided on the tab 10. One or more arcuate strips 28 are provided on the second surface 26 of the tab 10 proximate to the peripheral surface 18 of the tab 10. See, FIG. 3. The arcuate strips 28 are shown in black on FIG. 3 for the purpose of illustrating the location of where certain arcuate strips 28 may be located on the tab 10 and should not be considered as a limitation of the invention. The black highlighting is merely for the purpose of illustration. The arcuate strips 28 are a deformed, thinned or weakened preselected area of the tab 10 formed by way of example and not limitation, a coining tool, a score tool or the like. See FIG. 4 for a side view of the arcuate strips 28. While the FIGS. show the arcuate strips 28 located proximate to the nose portion 12, one of ordinary skill in the art would recognize that arcuate strips 28 could additionally be located proximate to the lift portion 14 if one desires to curl or hem the peripheral surface 18 proximate to the lift portion 14.

Figure 10:
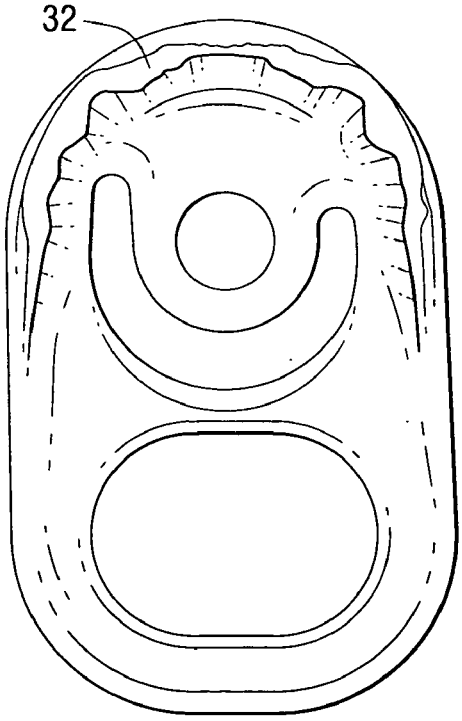
FIG. 10 PRIOR ART
FIG. 10 is a bottom plan view of a prior art beverage tab with a kinked or wrinkled curl.

The arcuate strips 28 define a preselected forming band that permit the arcuate strips 28 to bend, curl or form easily when the tab 10 contacts a curling die since the material has been deformed, thinned or weakened and other material of the tab 10 that follows further bends, curls or forms the curled or hemmed portions 16 in a controlled manner with improved metal flow. As an added benefit, the arcuate strips 28 allow the curled or hemmed portions 16 to be manufactured from reduced gauge tab stock because the forming band allows the arcuate strips 28 and the other material of the tab that follows to bend, curl or form in a predictable manner with improved metal flow. The improved metal flow in the bending, curling or forming process results in a tab 10 with reduced kinks or wrinkles appearing on the curled or hemmed portions 16. With reference to FIG. 10, a prior art beverage tab is shown displaying a kinked or wrinkled tab. The disclosed and claimed concepts minimizes the formation of kinks and wrinkles on the tab 10. The benefits of reduced kinks or wrinkles on the curled or hemmed portions 16 are, by way of example and not limitation: (i) the curled or hemmed portions 16 have a smoother finished look and are aesthetically appealing; (ii) the curled or hemmed portions 16 are formed into a new geometry that provides higher tab 10 strength; and (iii) the curled or hemmed portion 16 is manufactured with greater consistency which provides the tab 10 with more consistent tab strength.

Figure 2:
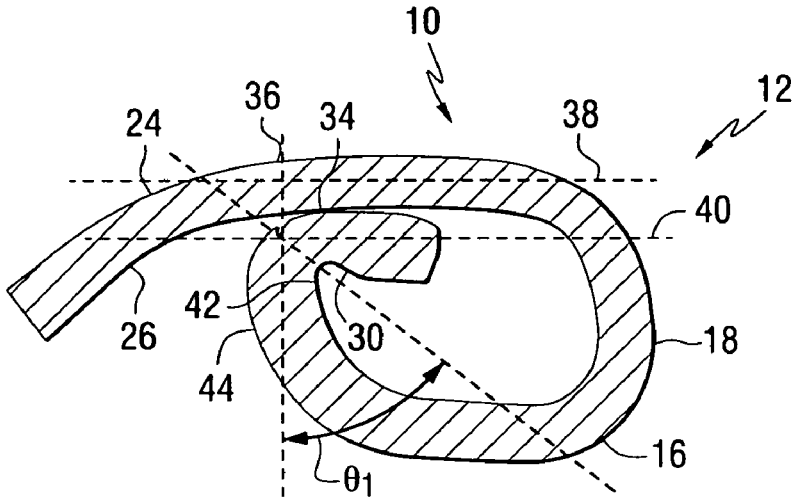
FIG. 2 is a side cross-sectional view of a curled or hemmed portion of a tab.

As can be seen in FIG. 2, the one or more arcuate strips 28 have been formed further into a preselected portion 30 of the curled or hemmed portions 16 of the tab 10. See, FIG. 2. The preselected portion 30 of the curled or hemmed portions 16 of the tab 10 changes the overall geometry of the curled or hemmed portions 16 of the tab 10 from certain existing curls 32 used in the industry. See FIG. 5 for a side cross-sectional view of existing curls 32 used in the industry. As can be seen in FIG. 2, the preselected portion 30 is located proximate to a contact portion 34. A top surface 36 of the tab 10 defines a first horizontal axis 38 and the contact portion 34 defines a second horizontal axis 40 with the first horizontal axis 38 being generally parallel to the second horizontal axis 40. The contact portion 34 has a bend, corner or kink 42 in the material formed from the arcuate strips 28.

Figure 5:
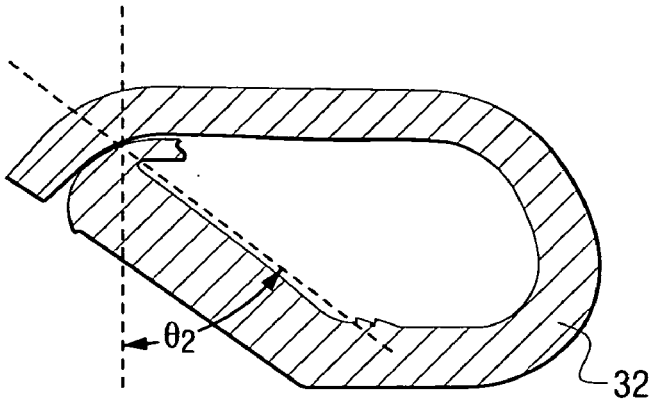
FIG. 5 PRIOR ART
FIG. 5 is a side cross-sectional view of a curled or hemmed portion of a prior art tab.

As can be seen by comparing FIG. 2 to FIG. 5, the tab 10 has a more pronounced inside wall segment 44 than the existing curls 32. The wall segment 44 is located proximate to the bend, corner or kink 42. The wall segment 44 has a greater vertical rise than the existing curls 32 and can withstand higher opening forces exerted upon the tab 10. The contact portion 34 increases contact of the first surface 24 of the tab 10 to the second surface 26 of the tab 10 proximate to the one or more arcuate strips 28 that have been formed further into the preselected portion 30 of the curled or hemmed portions 16 of the tab 10. The contact portion 34 of the first surface 24 coupled to the second surface 26 is due to the bend, corner or kink 42 of FIG. 2. As can be seen in FIG. 2, an axis drawn generally through the bend, corner or kink 42 forms an angle, $\theta_1$ relative to another axis drawn through the wall segment 44 of approximately 0 degrees to 40 degrees. Conversely, as can be seen in FIG. 5, an axis drawn generally through the bend of curl 32 forms an angle, $\theta_2$ relative to another axis drawn through a wall segment of curl 32 of greater than 45 degrees. While the example shown in FIG. 2 has an angle, $\theta_1$ of 0 degrees to 40 degrees, it should be noted that $\theta_1$ may have a value anywhere between 0 degrees to 40 degrees and other ranges falling within that range. The greater vertical rise of wall segment 44 improves tab 10 strength by increasing the overall rigidity of the curled or hemmed portion 16. The increased tab 10 strength allows the tab 10 to be manufactured from reduced gauge tab stock and minimizes kinks or wrinkles in the tab 10. See FIG. 10 for a view of the prior art beverage tab with a kinked or wrinkled curl.

The rivet receiving portion 20 is a generally semi-circular shaped, square shaped or rectangular shaped panel located rearwardly of the nose portion 12 with a central rivet hole 22. The rivet hole 22 is shaped to receive an integral rivet 46 to affix the tab 10 to a can end 48 about which the nose portion 12 can pivot. The rivet receiving portion 20 is integrally attached to the nose portion 12 along a panel 50. A C-shaped slot 52 surrounds a portion of the outer periphery of rivet hole 22 and the outer periphery of the rivet receiving portion 20. The C-shaped slot 52 is an aperture that further facilitates flexibility of the tab 10 with the opposed ends of the C-shaped slot 52 defining a fulcrum 54. The fulcrum 54 allows the tab 10 to pivot upwards and downwards about the fulcrum 54.

V-shaped detent 56 is provided proximate to the panel 50. The V-shaped detent 56 permits the tab 10 to bend more easily or readily about the integral rivet 46. The V-shaped detent 56 reduces the requisite opening force needed to open the can end 48.

Lift portion 14 is the part of the tab 10 actuated by an end-user to open the can end 10. The lift portion 14 is generally U-shaped with curled or hemmed portion 16 located along the peripheral surface 18 of the lift portion 14. The curled edges or hemmed portion 16 located proximate to the lift portion 14 are curled or hemmed underneath the lift portion 14. The lift portion 14 includes a finger hole 58 disposed through a surface of the lift portion 14 for user activation. While the finger hole 58 is shown as having the shape of an ellipse, one of skill in the art would appreciate that finger hole 58 could be in the shape of a circle, oval or other geometric shapes.

With reference to FIG. 1, the tab 10 of the invention is shown affixed to a standard can end 48 used in food applications. Can end 48 has an end panel 60 of generally circular shape which includes a circumferentially extending raised curl 62 for attaching the can end 48 to a suitable food can body (not shown) or the like. In general, the can end 48 will be manufactured of steel alloyed sheet or aluminum alloyed sheet.

The end panel 60 is defined by a score line 64 which surrounds the end panel 60 so the end panel 60 is removable from the can end 48 by an end-user when the score line 64 is fractured. The score line 64 is typically fractured by having the end-user grasp the lift portion 14 of the tab 10. The end-user then lifts the lift portion 14 upward which flexes the integral rivet 46 forward thereby causing the nose portion 12 and the V-shaped detent 56 to flex downward and fracture the score line 64. The end-user may then pull on the lift portion 14 to remove the end panel 60 from the remainder of the can end 48.

While the disclosure of FIG. 1 and the specification associated therewith is directed to a can end for food applications for the purpose of containing a food product or the like, the tab 10 of the invention can also be applied to other types of can ends that have the end panel captively retained to the can end or removable from the can end such as, for example, beer/beverage can ends. One of ordinary skill in the art would readily appreciate that the teachings of the invention would equally apply to can ends used in food applications as well as beer/beverage applications. As such, the tab 10 of the invention encompasses tabs that are affixed to food can ends, beer/beverage can ends and other can ends. It is noted that the details of the tab 10 of the invention affixed to other can ends has been omitted for the purpose of simplifying the specification and FIGS. of the invention.

In the tooling for the manufacture of the tab 10 of the invention and associated method, material to be converted into a plurality of tabs 10 is conveyed into a conversion press. In the typical operation of a conversion press, material is introduced between at least one upper tool member and at least one lower tool member that are in an open, spaced apart position. A ram advances the upper tool member toward a lower tool member in order to perform any of a variety of tooling operations such as rivet forming, hole punching, scoring, paneling, embossing and/or final staking. After performing an operation at a specific station, the press ram retracts until the upper tool member and lower tool member are once again in the open, spaced apart position. The partially converted material is transported to the next tooling station until the tab 10 is completely formed and discharged from the conversion press. As the material leaves a given tooling operation, more material is introduced to the vacated position, for example, as part of a continuous sheet, thus continuously repeating the manufacturing process.

Figure 6:
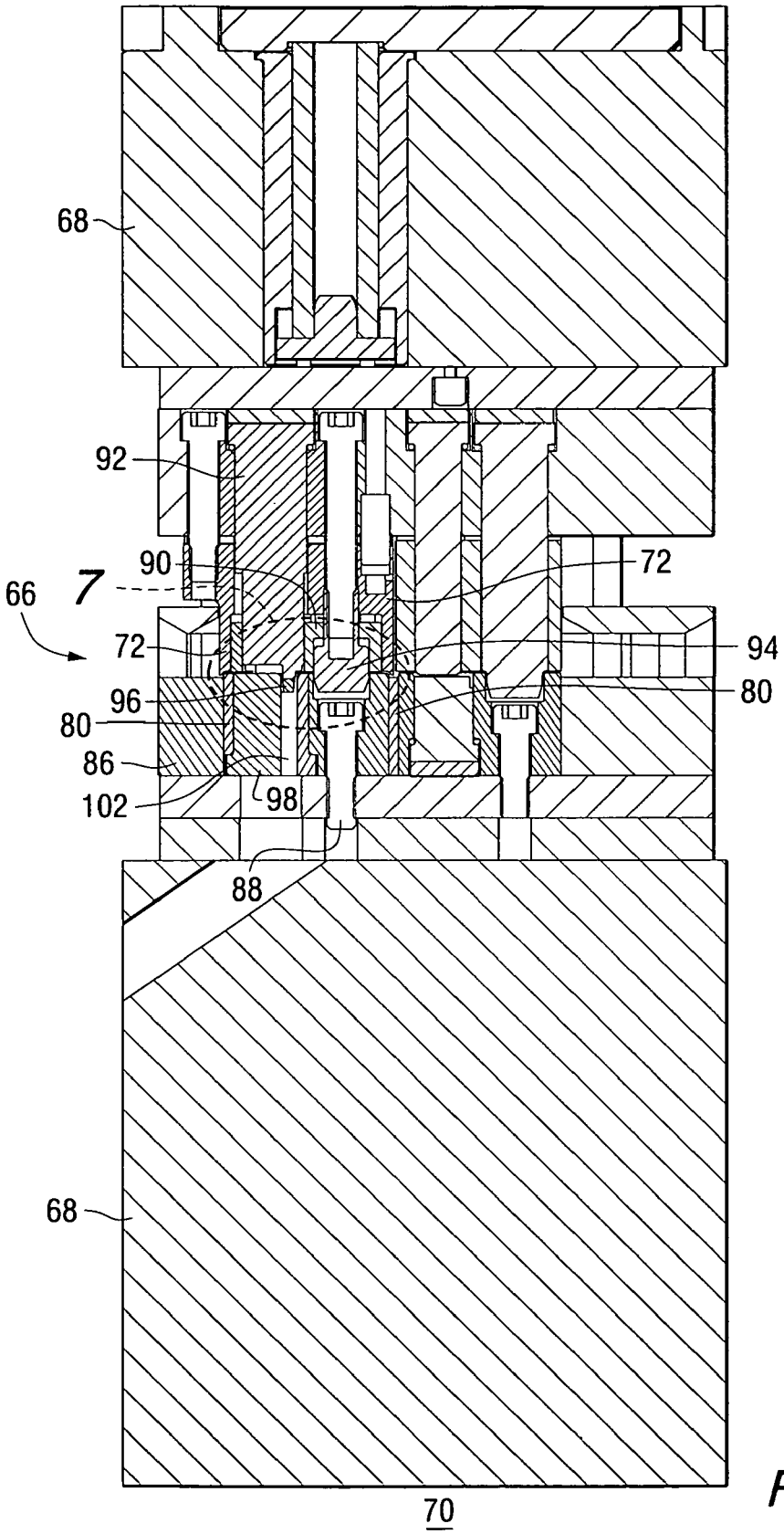
FIG. 6 is a side cross-sectional view of tooling coupled to a conversion press.

Tooling 66 for the manufacture of the tab 10 and a method for manufacturing the tab 10 of the invention is shown in FIGS. 6-9. As depicted in FIG. 6, tooling 66 of the invention is shown coupled to dies 68 coupled to a conversion press 70. A detailed view of the tooling 66 can be seen in FIG. 7. A first tool 72 is shown having a first generally planar surface 74 connected to an arcuate surface 76 connected to a first projection 78. A second tool 80 is shown having a second generally planar surface 82 connected to a second projection 84. Second tool 80 is coupled to a block 86. Block 86 is coupled to the conversion press 70 with a fastener 88. A stripper tool 90 is located proximate the first tool 72 with a portion of a punch 92 and a portion of a guide tool 94 disposed within the stripper tool 90. Punch 92 has a third projection 96 which is structured to wipe the C-shaped slot 52 of the tab 10. A die 98 is located proximate to the second tool 80 and an insert 100 is disposed with the block 86 wherein the die 98 and the insert 100 define an aperture 102 for receiving metal removed from the C-shaped slot 52 with the third projection 96. Block 86 has a recess 103 structured to receive guide tool 94.

The forming steps or processes described below occur in this station when the ram (not show) of the conversion press 70 begins to descend. The first generally planar surface 74 and the arcuate surface 76 of the first tool 72 cooperate with the second projection 84 of the second tool 80 to form arcuate strips 28 (see FIGS. 3-4) on the second surface 26 of the tab 10 proximate to a peripheral surface 18 of the tab 10. The second surface 26 of the tab 10 is the bottom surface of the tab 10. The second projection 84 may be a coining tool, a score knife or the like. A portion of the first tool 72 and the second projection 84 of the second tool 80 secure material of the tab 10 between the first tool 72 and the second tool 80 to form the arcuate strips 28 which define a preselected forming band. The arcuate surface 76 of the first tool 72 wipes the peripheral surface 18 of the tab 10 over the second tool 80 to form an arcuate surface 104 (see FIG. 4) on the tab 10. The third projection 96 of the punch 92 wipes the material of the C-shaped slot 52 downward and becomes coupled to the C-shaped slot 52. Any material that is removed from the C-shaped slot 52 travels through aperture 102 out of the station. Guide tool 94 holds the finger hole 58 and becomes coupled to the finger hole 58.

Next, the ram of the conversion press 70 begins to ascend once the forming steps described above have been completed. When the ram ascends, the stripper tool 90 is biased so the punch 92 coupled to the C-shaped slot 52 and the guide tool 94 coupled to the finger hole 58 lift out of these apertures and the stripper tool 90 is the last tool to ascend from the first surface 24 of the tab 10 such that the tab 10 is de-coupled from the punch 92 and the guide tool 94 with the stripper tool 90.

Figure 7:
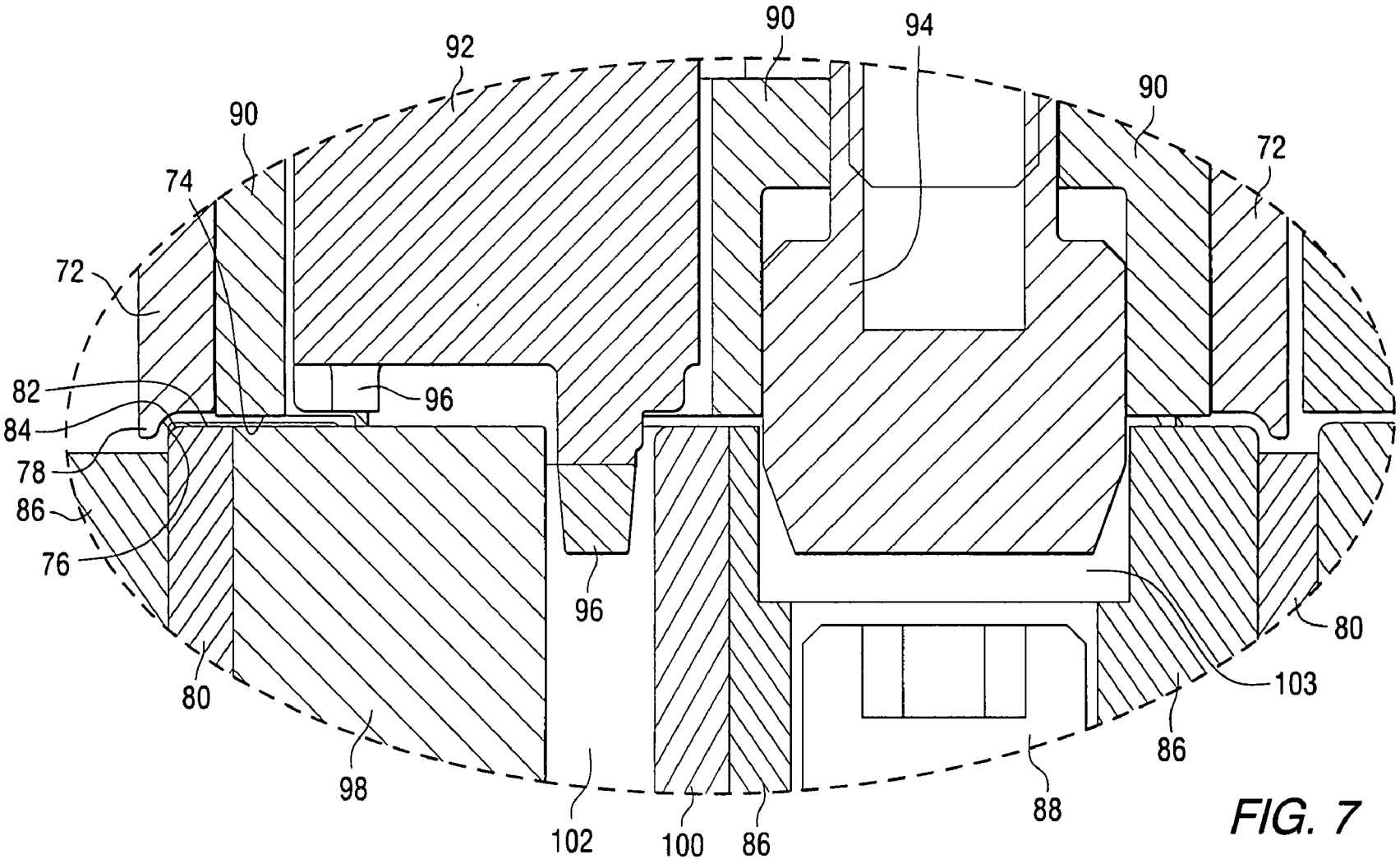
FIG. 7 is a side cross-sectional view of tooling circled in FIG. 6.

While FIG. 7 generally depicts one tooling station of a tab die in the conversion press 70, one of ordinary skill in the art would appreciate that many other tooling stations may be included in the tab die of the conversion press 70. Each station includes one or more tools, wherein each of the tools perform a tooling operation on the material. While a limited number of stations are included in the FIGS., the method of manufacturing the tab 10 of the invention can include numerous other stations not depicted here which are known in the art. Further, each of the stations can be housed in separate machine housings, in a single machine housing, or any combination thereof.

The material can be conveyed through the conversion press 70 by any means known in the art. Typically, material is fed into the conversion press 70 as sheets or is uncurled first and then fed into the conversion press 70 in sheets which is conveyed through the stations as a solid sheet until enough tooling operations have been performed on the material that separate tabs 10 are formed. Further, the material that manufactures tabs 10 is a relatively ductile metal such as, for example, aluminum alloyed sheet, but it may be made from other acceptable materials as required, such as, for example, steel alloyed sheet.

Figure 8:
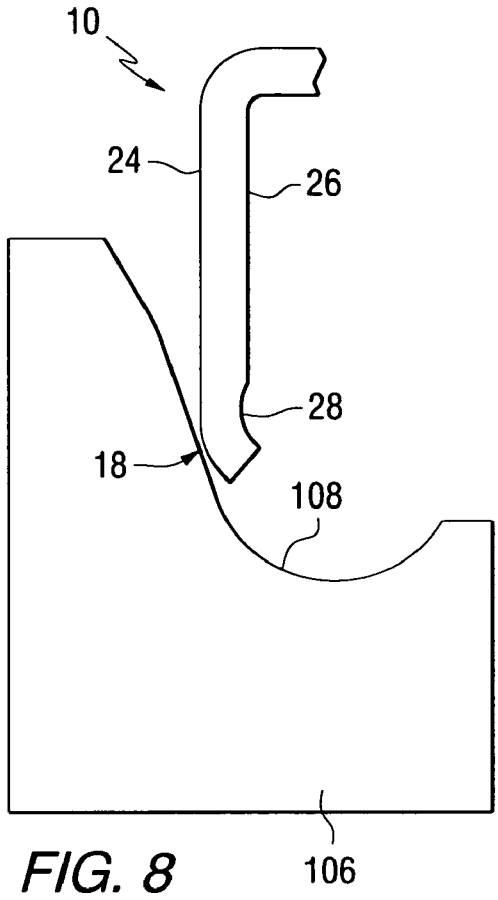
FIG. 8 is a side view of a tool structured to bend, curl or form a tab.
Figure 9:
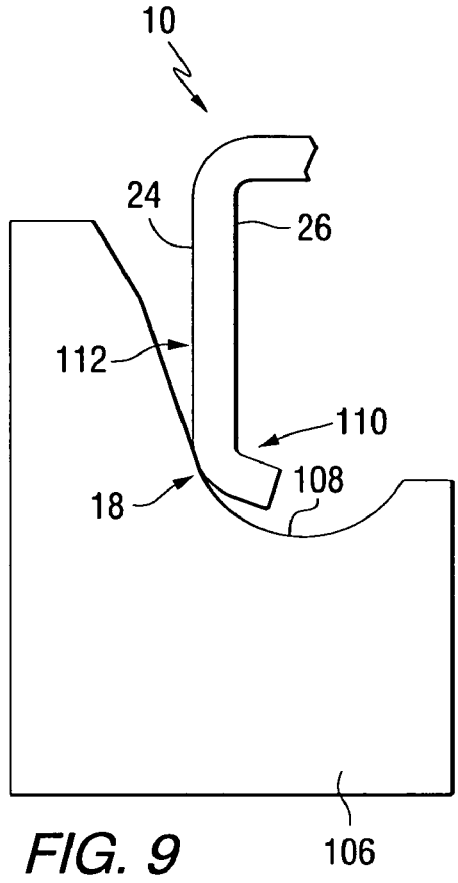
FIG. 9 is a side view of a tool structured to bend, curl or form a tab.

Turning to FIGS. 8-9, a third tool 106 is shown. The third tool 106 has an arcuate surface 108. The peripheral surface 18 of the tab 10 contacts the arcuate surface 108 of the third tool 106 to bend, curl or form the arcuate strips 28 to an intermediate or hemmed portion 110 and other material 112 of the tab 10 is structured to follow the intermediate curled or hemmed portion 110 to form the final curled or hemmed portion 16. The arcuate strips 28 define a preselected forming band. The preselected forming band allows the arcuate strips 28 to bend, curl or form easily when the tab 10 contacts the third tool 106 since the material has been deformed, thinned or weakened and other material 112 of the tab 10 that follows further bends, curls or forms to define the curled or hemmed portions 16 in a controlled manner with improved metal flow.

As an added benefit, the arcuate strips 28 allow the curled or hemmed portions 16 to be manufactured from reduced gauge tab stock because the forming band allows the arcuate strips 28 and the other material 112 of the tab that follows to bend, curl or form in a predictable manner with improved metal flow. The improved metal flow in the bending, curling or forming process results in a tab 10 with reduced kinks or wrinkles appearing on the curled or hemmed portions 16. The benefits of reduced kinks or wrinkles on the curled or hemmed portions 16 have been previously described. See FIG. 10 for a view of a prior art beverage tab with a kinked or wrinkled curl.

The tooling for the manufacture of the tab 10 and associated method may include additional tooling stations and steps. Those additional tooling stations and steps have been omitted from the FIGS. and specification for the purpose of simplifying the specification and FIGS. of the invention.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended hereto and any and all equivalents thereto.

What is claimed is:

1. A tab to be affixed to a can end, the tab comprising:

a nose portion located at a front end of the tab;

a lift portion located at a back end of the tab, the nose portion and the lift portion having curled or hemmed portions located proximate to a peripheral surface of the tab;

a rivet receiving portion located proximate to the nose portion with a rivet hole, the rivet receiving portion being attached to the nose portion;

a first surface is provided on the tab which is a top surface of the tab;

a second surface is provided on the tab which is a bottom surface of the tab; and one or more arcuate strips are provided on the second surface of the tab proximate to the peripheral surface of the tab, wherein the one or more arcuate strips comprise a thinned portion of the tab structured to be formed further into a preselected portion of the curled or hemmed portions of the tab, wherein an axis drawn generally through a middle of a bend proximate to the arcuate strips forms an angle, $\theta_1$ of approximately 0 degrees to 40 degrees relative to another axis drawn through a wall segment of the tab, and wherein a portion of the first surface is coupled to the second surface which defines a contact surface having an axis; wherein the top surface of the tab has an axis; and wherein the axis of the top surface of the tab is parallel to the axis of the contact surface.

2. The tab of claim 1, further comprising:

a slot having opposed ends located adjacent to the rivet hole surrounding a portion of an outer periphery of the rivet hole and an outer periphery of the rivet receiving portion, the ends of the slot defining a fulcrum, the fulcrum allowing the lift portion to pivot upwards and downwards about the fulcrum.

3. The tab of claim 2, wherein the slot is a C-shaped slot.

4. The tab of claim 1, further comprising a can end affixed to the tab.

5. The tab of claim 4, wherein the can end is selected from the group consisting of beer can ends, beverage can ends and food can ends.

6. The tab of claim 1, further comprising a finger hole located in the lift portion of the tab.

7. The tab of claim 1, wherein the one or more arcuate strips were formed by a tool selected from the group consisting of a coining tool and a score tool.

8. The tab of claim 1 wherein the top surface of the tab has an axis; and wherein the wall segment of the tab has a vertical rise in order that the axis of the wall segment of the tab is perpendicular to the axis of the top surface of the tab.

9. The tab of claim 1 wherein the arcuate strips are coined portions of the tab.

* * * * *

UNITED STATES PATENT AND TRADEMARK OFFICE

CERTIFICATE OF CORRECTION

PATENT NO. : 7,614,520 B2
APPLICATION NO. : 11/443803
DATED : November 10, 2009
INVENTOR(S) : Craig Allen McEldowney et al.

It is certified that error appears in the above-identified patent and that said Letters Patent is hereby corrected as shown below:

Column 3, line 14, "a tab" should read --the tab--.
Column 5, line 30, "has been" should read --have been--.
Column 6, line 5, "(not show)" should read --(not shown)--.

Signed and Sealed this

Twenty-third Day of November, 2010

David J. Kappos

David J. Kappos
*Director of the United States Patent and Trademark Office*